US007032855B2

(12) United States Patent
Shiga

(10) Patent No.: US 7,032,855 B2
(45) Date of Patent: Apr. 25, 2006

(54) MAGNETIC TAPE CARTRIDGE REEL

(75) Inventor: Hideaki Shiga, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 105 days.

(21) Appl. No.: 10/699,865

(22) Filed: Nov. 4, 2003

(65) Prior Publication Data

US 2004/0099762 A1 May 27, 2004

(30) Foreign Application Priority Data

Nov. 27, 2002 (JP) ..... P2002-344362

(51) Int. Cl.
*B65H 75/12* (2006.01)

(52) U.S. Cl. ..... 242/614

(58) Field of Classification Search ..... 242/614, 242/345, 348; 360/132
See application file for complete search history.

(56) References Cited

U.S. PATENT DOCUMENTS 3,620,474 A * 11/1971 Ray ..... 242/332.7

FOREIGN PATENT DOCUMENTS

JP 10-92143 A 4/1998
JP 11-185437 A 7/1999

* cited by examiner

*Primary Examiner*—John Q. Nguyen
(74) *Attorney, Agent, or Firm*—Sughrue Mion, PLLC

(57) ABSTRACT

A magnetic tape cartridge reel includes a hub having a first end and a second end configured to receive a magnetic tape to be wound thereon and at least one flange which is attached to at least one of the first end and the second end of the hub, wherein the at least one flange is formed separately from the hub and is made of a flexible material.

8 Claims, 6 Drawing Sheets

MAGNETIC TAPE CARTRIDGE REEL

BACKGROUND OF THE INVENTION

1. Field of the Invention

The present invention relates to a magnetic tape cartridge reel on which a magnetic tape is wound and stored within a magnetic tape cartridge.

2. Description of the Related Art

Conventionally, as a magnetic tape cartridge which has been used as a recording medium for use in external memory such a computer, there is known a magnetic tape cartridge of a type in which a single reel with a magnetic tape is wound thereon. The magnetic tape cartridge is used for storing data of a computer.

As shown in FIG. 6, this type of magnetic tape cartridge 1 is composed in such a manner that a reel 7 consists of a lower flange and an upper flange welded by ultra sonic welding is rotatably stored into a cartridge case 11 composed of an upper case 11*a* and a lower case 11*b* fastened together with screws.

The lower flange 3 is made of synthetic resin and is an integral body composed of a cylindrical-shape hub 13 on the outer periphery on which the magnetic tape is wound, and a flange 15 projected in the radial direction of the hub 13 from the lower end outer periphery of the hub 13. On an outer surface of the bottom portion of the hub 13, there is mounted a reel plate 8 to which magnet-type rotation drive means for driving and rotating the reel 7 are connected. Also, in an inner surface of the bottom portion of the hub 13, there is formed a restricting gear 13*a* which meshes with a restricting gear 32*a* formed in a brake member 30 so as to restrict the rotation of the reel 7 when it is not in use. Further, in the hub 13, there is formed an opening 13*b* through which a drive removing spindle which is set in a recording and reproducing apparatus such as external memory using the magnetic tape cartridge 1 can be inserted so as to move the brake member 30 upwardly. Further, around the opening 13*b*, there is formed a ring-shape groove 13*c* fitting in the brake member 30.

The brake member 30 has a first member 31 of the cylindrical-shape with a bottom surface and a second member 32 of a cylindrical-shape with a bottom surface in which the restricting gear is formed. On the upper surface of the second member 32, there is formed a cross-shape projection 32*b* which always meshes with a cross-shape groove (not shown) which is formed in the upper case 11*a*.

On the other hand, an upper flange 5 is disc-shape and is welded integrally to the lower flange 3 by ultra sonic welding. In the center of the upper flange 5, there is formed an opening 5*a* through which an opening edge 13*b* of the hub 13 is fittingly inserted. As described above, the reel 7 composed of the upper flange 5 and the lower flange welded integrally is biased downward by a reel spring 21 which is attached on the brake member 30 when the reel 7 is stored into the cartridge case 11.

As the magnetic tape cartridge is set to the recording and reproducing apparatus, the meshing engagement of the restriction gear 32*a* and the restriction gear 13*a* for restricting the brake member 30 and the hub 13 is released so that the reel 7 can be rotated freely. A magnet-type rotation drive means (winder) connects to the reel plate 8 exposed on the center opening 11*c* of the lower case 11*b*. A reader tape 23 is introduced to a predetermined tape traveling pass to be able to record and reproduce date on the magnetic tape 9.

An example of a reel for using in the above magnetic tape cartridge is disclosed in the Japanese patent unexamined publication JP-11-185437-A. Also, in the above magnetic tape cartridge, the magnetic tape is wound on the reel involving in air so called an involved-in air badly affects the rolled posture of the magnetic tape. For example, a technology of preventing this bad influence is disclosed in Japanese patent unexamined publication JP-10-92143-A.

The above-cited JP-10-92143-A discloses, as shown in FIG. 7, on the inner surface of the flange 15, that there are formed a plurality of grooves 15*a* to release the involved-in air. But there is a problem that enlarging the thickness in the radial direction of the groove 15*a* to improve the functionality of releasing the involved-in air, causes the width of a convex 33 (a part of contacting magnetic tape) between the adjoining concaves to be decreased. And an edge damage of the magnetic tape 9 becomes remarkable. This is, because the flange 15 forming the reel has high rigidity, in the case when the tape edge contacts with the flange when the magnetic tape is wound on the reel, the edge of the magnetic tape is damaged easily. The conventional reel is composed of the hub 13 and the flange 15 projected in the radial direction of the hub 13 from the lower end outer periphery of the hub 13. In the conventional reel, the hub 13 and the flanges are integrally formed from a synthetic resin, so that it is difficult to make the rigidity of only the flanges 15 themselves low.

Even, when a tape is running, if there is a shifted portion 25 (a step or an undulation) in the direction of the width on the magnetic tape 9 as shown in FIG. 8(*a*) tape wound body 27 contacts with the flange 15 (or upper flange 5) as shown in FIG. 8(*b*). As a result, the impact force would concentrate to the shifted portion 25. Accordingly, there easily occurs edge damages such as bending or collapsing. In this case, there is a possibility that some of servomechanism or some of running/recording position detecting systems can not detect the tape edge and the tape can not run.

Also because in the conventional reel 7, the hub 13 and the flange 15 projected in the radial direction of the hub 13 from the lower end outer periphery of the hub 13 are integrally formed, it was difficult to form right angle between the peripheral surface of hub 13 and the flange 13 with high precision, so it needs high technology to make it with high dimensional and shape precision such as the flatness or blur of the plane.

SUMMARY OF THE INVENTION

The present invention aims at eliminating the drawbacks found in the mentioned conventional magnetic tape cartridge reel. Accordingly, it is an object of the present invention to provide a magnetic tape cartridge reel in which, the edge damage of the magnetic tape is little, its wound shape is kept well, and has desirable precision in dimensional and shape.

In attaining the above object, according to the present invention as set forth in a first aspect, there is provided a magnetic tape cartridge tape reel having: a hub having a first end and a second end configured to receive a magnetic tape to be wound thereon, at least one flanges which is attached to at least one of the first end and the second end of the hub, wherein at least one flange is formed separately from the hub and is made of a flexible material.

In this magnet tape cartridge reel, the flange attached to the side of the hub is formed separately from the hub, the flanges are made of flexible material, and the rigidity of the flanges becomes low. Because of this composition, the impact undergoing the magnetic tape can be reduced, even when a magnetic tape is wound on the reel and an edge of the magnet tape collides the flange. Or even when the magnetic tape cartridge gets damages from falling, damages of the edge of the magnetic tape are reduced as well. The situation that some of servomechanism or some of running/recording position detecting systems can not detect the tape edge and the tape can not run is prevented beforehand. Further, because the hub and the flange are separately formed, the hub can be made to simple shape, it becomes easy to improve the shape-precision of the injection molding.

At least one of the hub and the at least one flange may be one of cylinder-shape, and polygon shape, said polygon having at least three sides.

It is desirable in the magnetic tape cartridge, wherein the flexible material is made of porosity film or porosity sheet which air can pass there through.

According to this composition, when the tape is wound on the reel, an involved-in air releases from the micro holes of the flanges, this becomes to obtain a desirable wound shape of the magnetic tape. Further, the magnetic tape cartridge reel may have at least one portion on the outer surface of the at least one flange is positioned between a perimeter of the at least one flange, and an aperture of the at least one flange. Also, the at least one portion may be concentric with an outer perimeter of the at least one flange.

The portion is greater in specific gravity than the flange. Also, the portion may have a shock proof and shock absorbing function, too. The portion is made of shockproof material such as foaming material, or a shock-absorb material. Also, this portion may be a resin that is a solid. This portion may be formed in applying liquid and stiffening it.

The at least one portion may have a single unit having a substantially similar to the perimeter of the at least one flange, or may have a plurality of units dispersed around said aperture of said flange.

According to this composition, when the magnetic tape is subjected to an impact shock, the portion between the cartridge case and the flanges absorbs the shock. Also, since the portion is between the cartridge case and the flange, there is generated a space, which is thickness of the portion. Because of the space, flanges can bend, so further the shock given to the tape is absorbed. Further, because a centrifugal force is added and the tensile strength of the flanges becomes strong, when the flange rotates, the flanges can have an enhanced force for maintain their plain shape.

DETAILED DESCRIPTION OF THE PREFERRED EMBODIMENTS

Now, description will be given to below in detail of embodiments of a magnetic tape cartridge reel according to the present invention with reference to the accompanying drawings.

Figure 1:
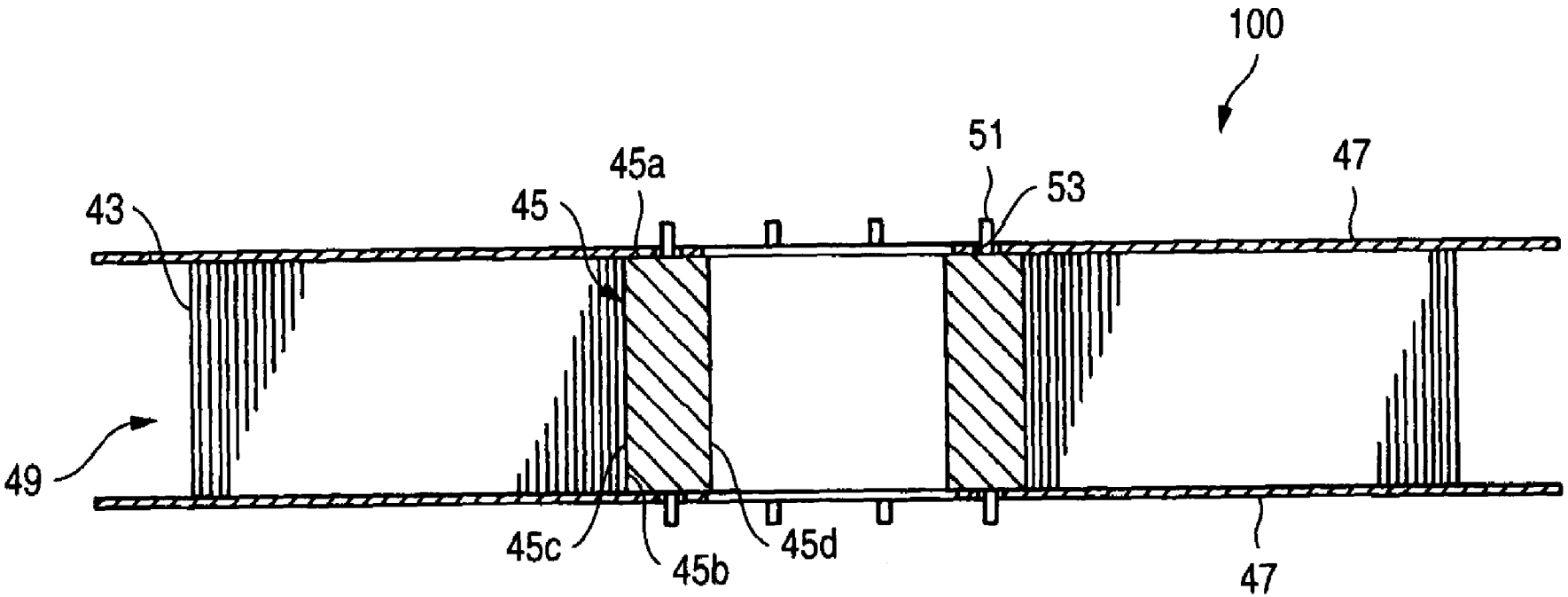
FIG. 1 is a longitudinal section of a structure of a magnetic tape cartridge tape reel according to the present invention.
Figure 2:
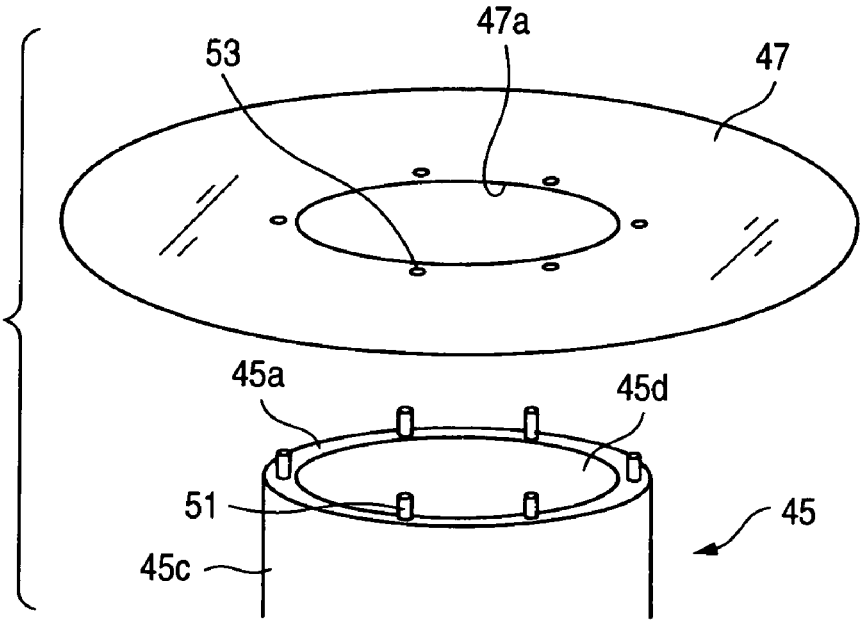
FIG. 2 is an exploded perspective view of a hub and a flange shown in FIG. 1.
Figure 3:
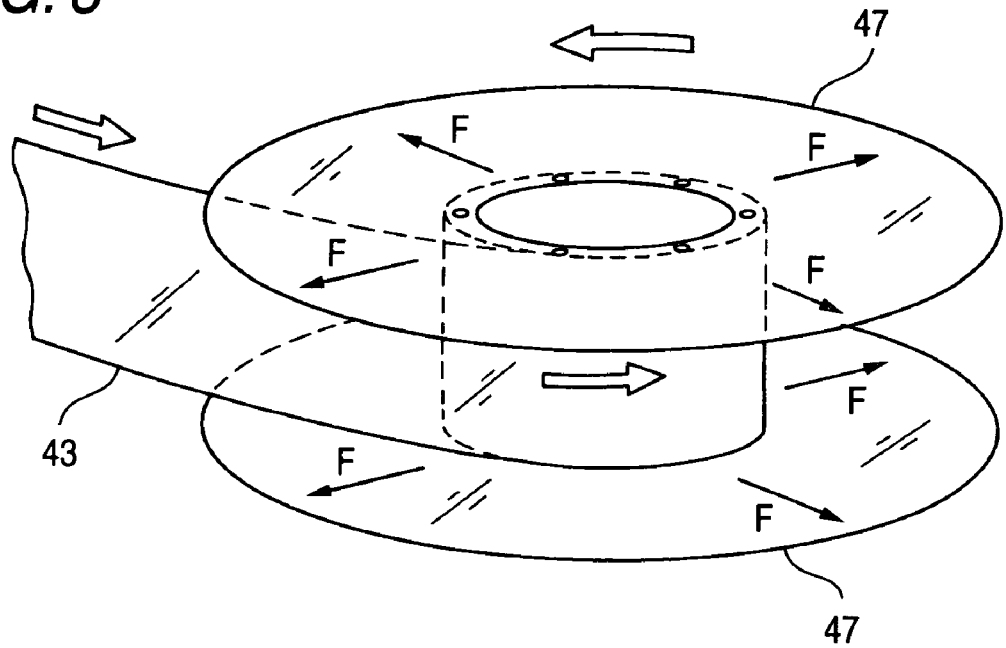
FIG. 3 is an operational view of the magnetic tape cartridge reel shown in FIG. 1.

FIG. 1 is a longitudinal section of a first embodiment of a magnetic tape cartridge tape reel according to the present invention. FIG. 2 is an exploded perspective view of a hub and a flange shown in FIG. 1. FIG. 3 is an operational view of the magnetic tape cartridge reel shown in FIG. 1.

As shown in FIG. 1, a magnetic tape cartridge reel 100 (Hereafter, only described as a reel) comprises; A hub 45 where a magnetic tape 43 is wound around the perimeter, a pair of flanges 47, 47 attached on the both end-side surfaces 45*a*, 45*b* of the axial direction of the hub 45. In this embodiment, the hub 45 is formed cylindrical-shape as shown in FIG. 2, the both end-side surfaces of the axial direction open and are ring-shape in plane.

Each flange 47 is made of flexible material and is separately formed from the hub 45. The diameter of the flange 47 is the same or larger than that of the tape wound body 49 (which magnetic tape 43 is wound). Also, the flange 47 is formed cylindrical-shape, inner hole 47*a* is formed as same as inner hole 45*d* of hub 45.

On the both end-side surfaces of the axial direction, a plurality of pins 51 projecting along with the axial direction are installed in the direction of the circumference at the predetermined intervals. A plurality of holes 53 to which the pin 51 inserts are dug by the surrounding inner holes 47*a* of the flange 47 which correspond both end-side surface 45*a*, 45*b* of the hub 45. The holes 53 are formed a little larger than the diameter of pin 51, the flange by which the pin is inserted in the hole is attached so that it can move a little. A distortion by the wrinkles resulting from a manufacture error does not arise in the flange which consists of a film when the flange is attached to the hub 45.

In the mentioned manner, flanges 47 are attached in the both-ends side surfaces of the hub 45*a*, 45*b*, respectively, and the reel 100 is stored so that it can rotate in a cartridge (not shown).

Also, the films used in the flange 47,47 are porosity films which have a plurality of micro holes through which air can pass.

As this porosity film, "super-high density polyethylene" by NITTO DENKO can be used, for example. Sheet may be used instead of the films. The thickness of the films or the sheets is required 0.03~0.5 mm, desirable 0.05~0.4 mm, further desirable 0.05~0.3 mm.

The flange 47 which consists of such a porosity film is adopted, so called an involved-in air generated as magnetic tape 43 is wound on the reel 100 misses from the micro hole of the flange 47, the magnetic tape 43 hardly becomes volume disorder. Since it is not necessary to form concaves for missing an involved-in air as conventional, and the convex between the adjoining concaves is not formed, edge damages are hardly occurred.

In the reel 100 which has such composition, for example, a winder (not shown) of the driving system is attached from the lower side of the hub 45, as hub 45 rotates, each flanges 47 which are attached on the both end-side 45*a*, 45*b* of the hub 45 via screws rotate together. At this time, the flange 47, as shown in FIG. 3, is stretched to the radius direction outside from the centrifugal force F, will be stretched by the predetermined tension. The magnetic tape 43 which is wound on the hub 45 is restrict to move in the width direction and is wound on the peripheral 45*c* of the hub 45 in order.

According to the reel 100 of the embodiment, the flanges 47 attached to the both end-side 45*a*, 45*b* of the hub 45 are consist of a film of which rigidity is low, when the magnetic tape 43 is wound on the reel 100, even a tape edge collides the flanges 47, the damage of the magnetic 43 is reduced. And even when the magnetic tape cartridge is damaged from falling, the edge damage of magnetic tape is reduce as well, the situation that it becomes impossible to run since edge detection in servomechanism or in the detecting system of running position or recording position becomes impossible is prevented beforehand. Further, because the hub 45 and the flanges 47 are separated, the hub 45 can be made to simple shape, it becomes easy to improve the shape-precision of the injection molding.

Next, the second embodiment of magnetic tape cartridge of the present invention is explained.

Figure 4:
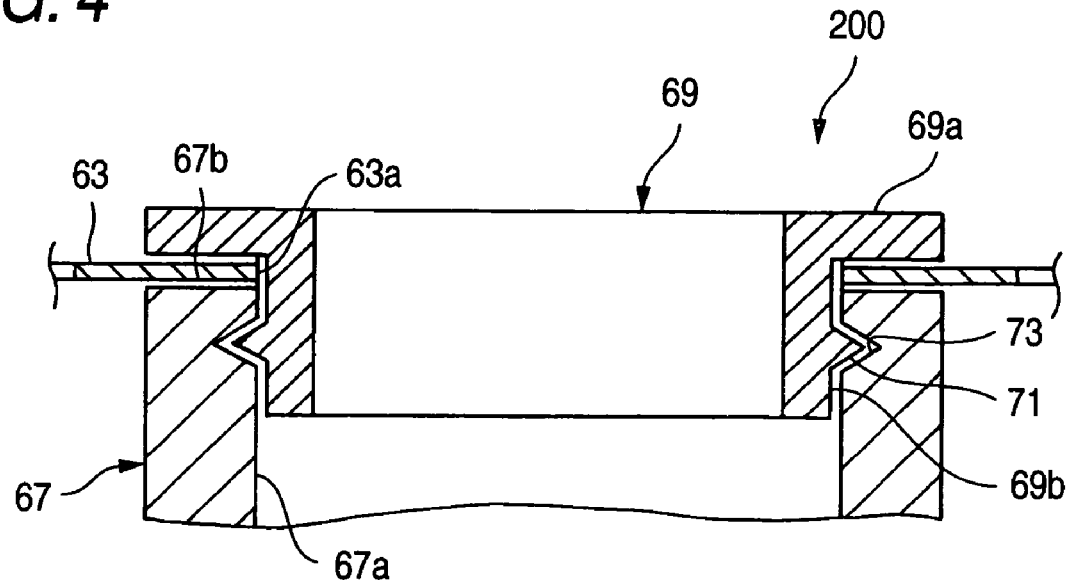
FIG. 4 is a longitudinal section of an example of a structure of the magnetic tape cartridge reel in which the flanges fixed by a case.

FIG. 4 is a longitudinal section of the second embodiment of the magnetic tape cartridge reel.

The reel 200 of the embodiment is, as well as the above-mentioned embodiment reel 100, a flange 63 and a hub 67 are formed separately, and the flange 63 consists of a flexible material. In the inner hole 67*a* of the hub 67, the cylinder 69 on which one end has a brim 69*a* is inserted.

In the cylinder 69, the diameter of the brim 69*a* is formed as same as that of hub 67. On the peripheral 69*b* of the cylinder 69, there are projections 71. The projections 71 fit in the concave 73 which is formed on the inner hole 67*a* of the hub 67. Because the cylinder 69 inserted in the inner hole 63*a* of the hole 63 further fits in the inner hole 67*a* of the hub 67, the peripheral of the inner hole 63*a* is sandwiched between the brim 69*a* and the end side 67*b* of the hub 67, and the flange 63 is fixed.

In this embodiment, the member with brim is cylinder-shape, but the member with brim may be polygon shape, the polygon having at least three sides.

According to this reel 200, as well as the above-mentioned embodiment, in addition to the edge damage of the magnetic tape being reduced, compared with installing the plurality of pins 51 on the both end side of the hub 67, the shape of the flange 63 and the hub 67 become simple, also, flange 63 can be fixed only by inserting the cylinder 69 to the hub 67, the assembling process may be reduced, it may manufacture at low cost.

Next, the third embodiment of the magnetic tape cartridge reel of the present invention is explained.

Figure 5:
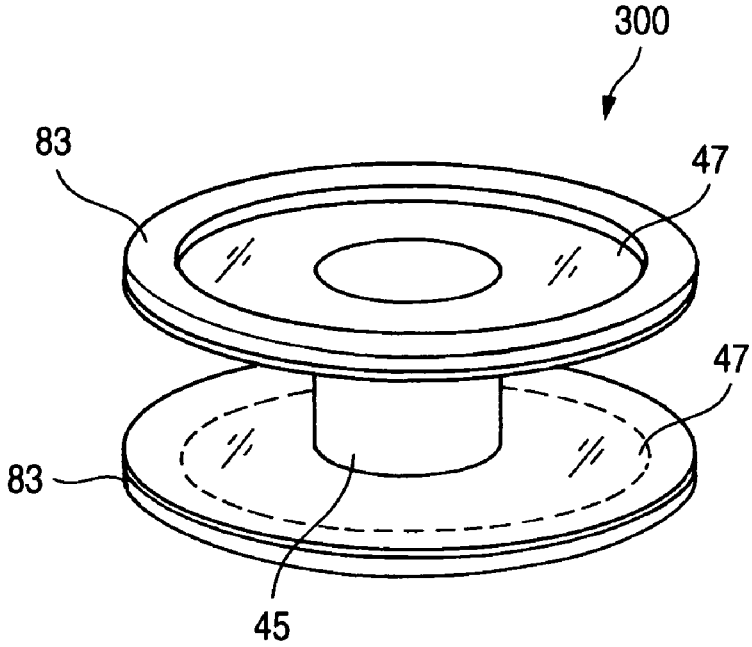
FIG. 5 is an appearance perspective view of the magnetic tape cartridge reel comprising a portion having a single unit having a substantially similar to the perimeter of the flange is attached on the flanges.
Figure 6:
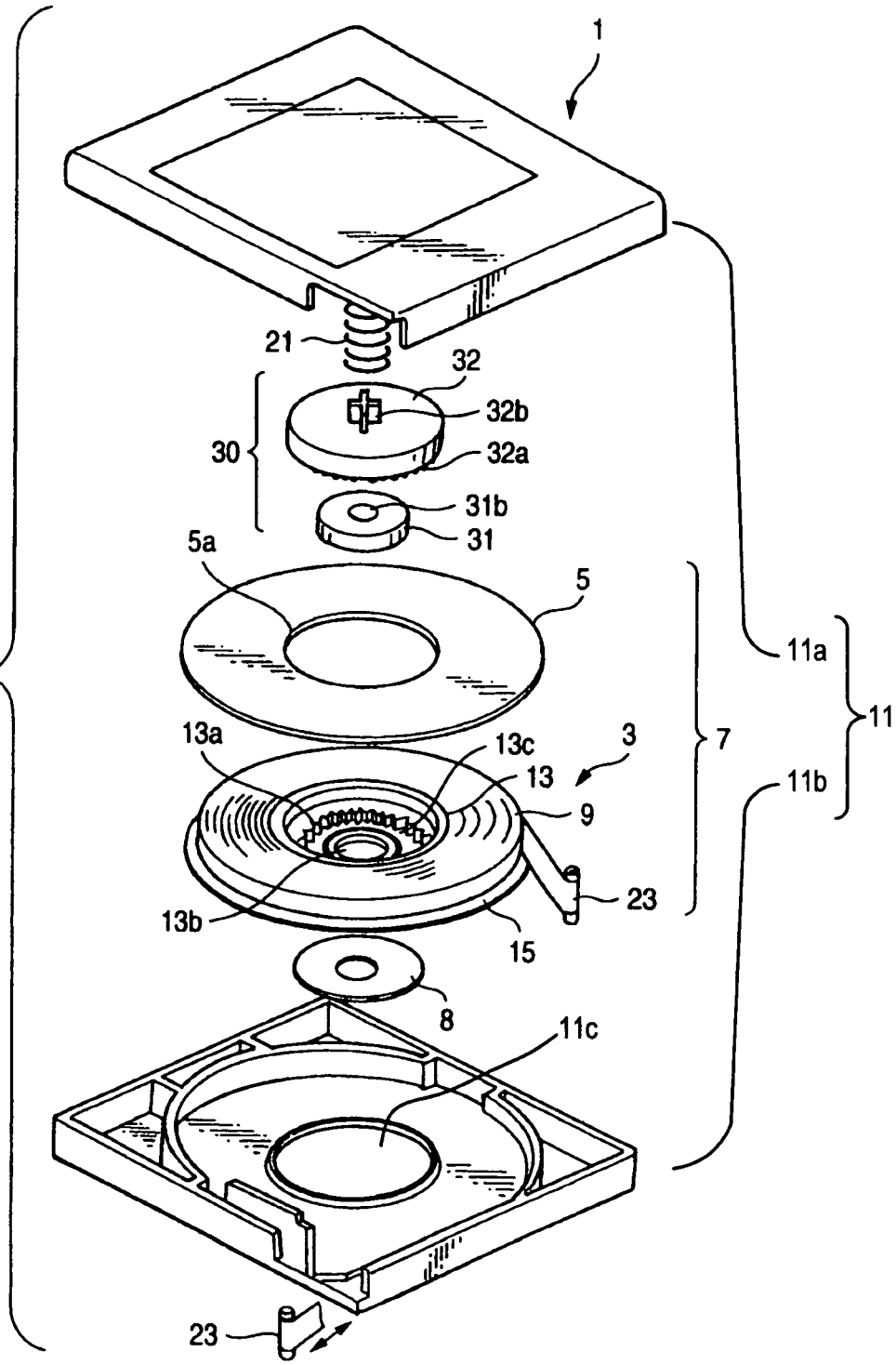
FIG. 6 PRIOR ART
FIG. 6 is an exploded perspective view of the conventional magnetic tape cartridge.
Figure 7:
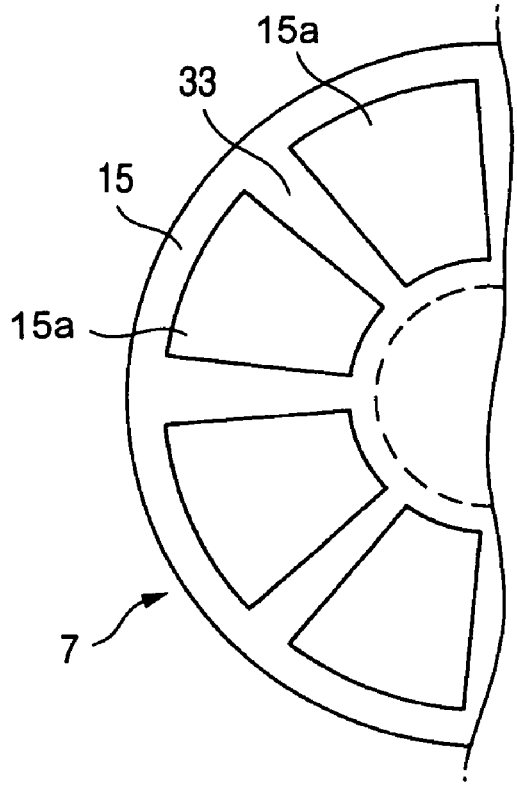
FIG. 7 PRIOR ART
FIG. 7 is a plane view which cuts a part of the conventional flange on which a concave is formed for missing an involved-in air in the reel.
Figure 8A:
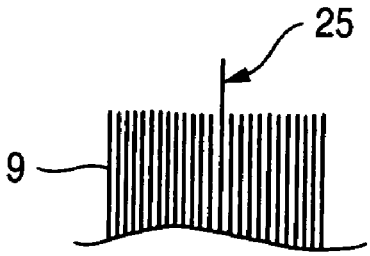
PRIOR ART FIG. 8A
FIG. 8*a* shows an undulation of a magnetic tape and FIG. 8*b* shows the damage-generating situation of the tape edge in the conventional reel.
Figure 8B:
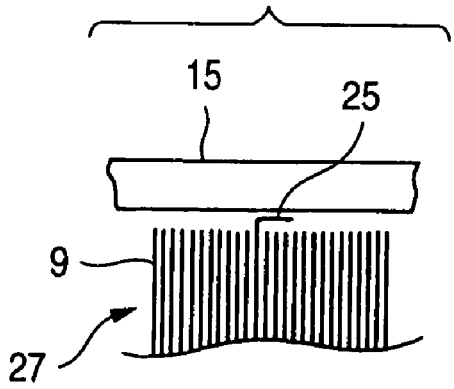
PRIOR ART FIG. 8B
Figure 9:
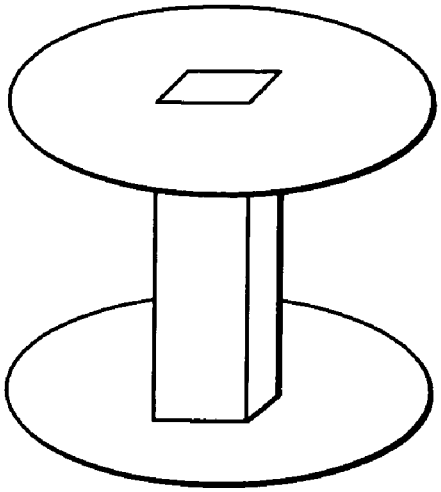
FIG. 9 is an appearance perspective view of the magnetic tape cartridge reel comprising cylinder shape flanges and a polygon shape hub.
Figure 10:
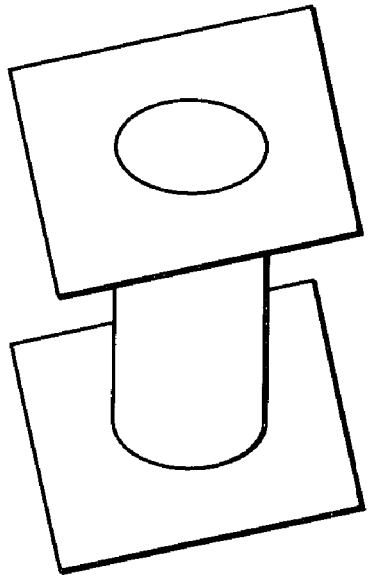
FIG. 10 is an appearance perspective view of the magnetic tape cartridge reel comprising polygon shape flanges and a cylinder shape hub.
Figure 11:
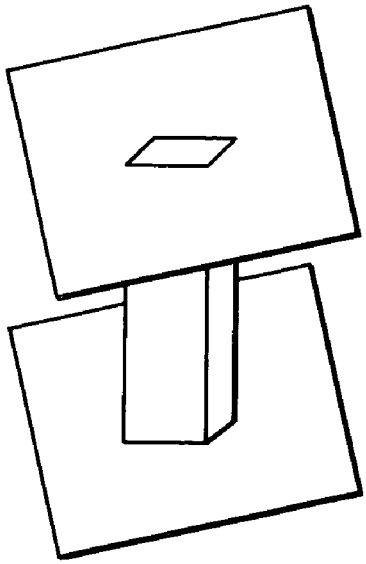
FIG. 11 is an appearance perspective view of the magnetic tape cartridge reel comprising polygon shape flanges and polygon shape hub.

FIG. 5 is an appearance perspective view of the magnetic tape cartridge reel of this embodiment.

The reel 300 of this embodiment is, a ring-shape portion 83 comprises a single unit having a substantially similar to the perimeter of the flange 47 is formed on the flange 47 positioned between a perimeter of the flange 47 and an aperture of the flange 47.

The ring-shape portion 83 may have a shock proof and shock absorbing function. As the material of this ring-shape portion 83, for example, foaming material which has shock proof property and shock absorbing property is preferable. And it is desirable that the specific gravity of the material is heavier than the film which composes the flanges 47. In this embodiment, this ring-shape portion 83 is attached on the most out side peripheral of the flange 47. Also, this ring-shape portion 83 maybe formed in applying liquid and stiffening it.

According to the reel of this embodiment, the ring-shape portion 83 is attached on the flange 47, the larger centrifugal force F is given when the reel 300 rotates, and as a result, the tensile strength of the flange 47 becomes strong, the still higher degree of plane is obtained. And the plane maintenance force becomes strong, and the end surface of the tape wound body 49 (refer to FIG. 1) is restricted to be the high degree of plane following to the flange 47.

Also, according to the reel 300 of this embodiment, when a shock is given to the magnetic tape cartridge, the ring-shape portion 83 between the magnetic tape cartridge case and the each flange 47 absorbs the shock. Also, since the ring-shape portion 83 is inserted between the magnetic tape cartridge case and the flange 47, there is generated a space, which is thickness of the ring-shape portion 83. Because of the space, the flange 47 can be bend, so further absorbs the shock given to the magnetic tape 43 is absorbed.

Figure 12:
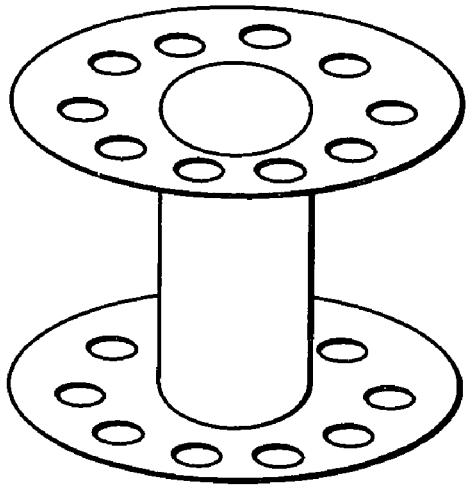
FIG. 12 is an appearance perspective view of the magnetic tape cartridge reel comprising a portion having a plurality of units dispersed around the aperture of the hub attached on the flange.

In addition, besides the sheet material is prepared in the shape of a concentric circle, the at least one portion has a plurality of units dispersed around said aperture of the hub (shown in FIG. 12). Also in this case, the same effect as the above mentioned is done.

Even the reel 100, 200, 300 of each embodiment of the above is explained the type for an example as a single reel on which a magnetic tape is wound is rotatably stored within a case. The present invention is not only this embodiment, for example, it can apply to such type as it has more than two reels such as videotape.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

According to the magnetic tape cartridge of the present invention, the flanges which are attached on the both side of the hub are film, the rigidity of the flanges are lower, when the magnetic tape is wound on the reel, the edge damage which generates the edge of the magnetic tape collides the flange can be reduced. And when the shock is given to the magnetic tape cartridge from falling, the edge damage of the magnetic tape can be reduce as well, the situation that it becomes impossible running since edge detection in servomechanism or in the detecting system of running position or recording position becomes impossible is prevented beforehand. Further, because the hub and the flange are separated, the hub can be made to simple shape, it becomes easy to improve the shape-precision of the injection molding.

What is claimed is:

1. A magnetic tape cartridge reel comprising:

a hub having a first end and a second end configured to receive a magnetic tape to be wound thereon;

at least one flange which is attached to at least one of the first end and the second end of the hub;

wherein the at least one flange is formed separately from the hub and is made of a flexible material, and wherein the flexible material of the at least one flange is porous.

2. The magnetic tape cartridge reel as set forth in claim 1, wherein said hub is one of cylinder-shape, and polygon shape, said polygon having at least three sides.

3. The magnetic tape cartridge reel as set forth in claim 1, wherein said at least one flange is one of cylinder-shape, and polygon shape, said polygon having at least three sides.

4. The magnetic tape cartridge reel as set forth in claim 1, wherein said at least one flange is made of film or sheet.

5. The magnetic tape cartridge reel as set forth in claim 1, wherein the at least one flange is made of one of a porosity film and a porosity sheet.

6. The magnetic tape cartridge reel as set forth in claim 1, wherein the thickness of the at least one flange is between 0.03 mm and 0.50 mm.

7. The magnetic tape cartridge reel as set forth in claim 1, wherein the thickness of the at least one flange is between 0.05 mm and 0.40 mm.

8. The magnetic tape cartridge reel as set forth in claim 1, wherein the thickness of the at least one flange is between 0.05 mm and 0.30 mm.

* * * * *